US009127884B2

(12) United States Patent
Ciaschi et al.

(10) Patent No.: US 9,127,884 B2
(45) **Date of Patent: *Sep. 8, 2015**

(54) ACOUSTIC DRYING SYSTEM WITH INTERSPERSED EXHAUST CHANNELS

(71) Applicant: Eastman Kodak Company, Rochester, NY (US)

(72) Inventors: Andrew Ciaschi, Pittsford, NY (US); James Douglas Shifley, Spencerport, NY (US); Rodney Ray Bucks, Webster, NY (US); Thomas Nathaniel Tombs, Rochester, NY (US)

( * ) Notice: Subject to any disclaimer, the term of this patent is extended or adjusted under 35 U.S.C. 154(b) by 234 days.

This patent is subject to a terminal disclaimer.

(21) Appl. No.: 13/693,344

(22) Filed: Dec. 4, 2012

(65) Prior Publication Data

US 2014/0150284 A1 Jun. 5, 2014

(51) Int. Cl.
*F26B 21/00* (2006.01)

(52) U.S. Cl.
CPC ..... *F26B 21/004* (2013.01)

(58) Field of Classification Search
CPC ..... F26B 11/00; F26B 19/00; F26B 21/00; F26B 21/006; F26B 21/008; B41J 11/00; F24H 3/00; B05B 17/00; B05B 17/06; B08B 3/00; B08B 6/00; B08B 7/00
USPC ..... 34/60, 68, 279, 620, 624, 218, 241; 347/34, 101, 102; 165/45, 48.1; 239/4, 239/107.2, 338; 134/1.3, 2, 26, 33, 34
See application file for complete search history.

(56) References Cited

U.S. PATENT DOCUMENTS

| | | | | |
|---|---|---|---|---|
| 3,694,926 | A * | 10/1972 | Rodwin et al. | 34/69 |
| 3,750,306 | A * | 8/1973 | Rodwin et al. | 34/69 |
| 6,325,475 | B1 * | 12/2001 | Hayes et al. | 347/2 |
| 6,340,225 | B1 * | 1/2002 | Szlucha | 347/102 |
| 6,393,719 | B1 | 5/2002 | Stipp | |
| 6,431,702 | B2 | 8/2002 | Ruhe | |
| 6,754,457 | B2 | 6/2004 | Ciaschi et al. | |
| 6,766,593 | B2 * | 7/2004 | Laudat et al. | 34/275 |
| 6,920,704 | B1 * | 7/2005 | Silverbrook et al. | 34/422 |

(Continued)

FOREIGN PATENT DOCUMENTS

JP 07-055338 3/1995

OTHER PUBLICATIONS

Gene, Plavnik, "Innovative drying technology can improve productivity," GravurEzine, pp. 8-12, http://www.gravurexchange.com/articles/heat-technologies.htm, Apr. 2011.

*Primary Examiner* — Stephen M Gravini
(74) *Attorney, Agent, or Firm* — Kevin E. Spaulding

(57) ABSTRACT

An acoustic air impingement drying system is provided for drying a material. An inlet chamber receives air from an airflow source provides air at a supply flow rate. A plurality of acoustic resonant chambers are provided, each having an inlet slot that receives air from the inlet chamber and an outlet slot that directs air onto the material, wherein the acoustic resonant chambers impart acoustic energy to the transiting air, the outlet slots being oriented at an oblique angle relative to the width dimension of the pneumatic transducer unit. A plurality of exhaust air channels interspersed between the outlet slots remove the air directed onto the material by the acoustic resonant chambers. A blower pulls air through the exhaust air channels at an exhaust flow rate.

12 Claims, 10 Drawing Sheets

(56) References Cited

U.S. PATENT DOCUMENTS

| | | | | |
|---|---|---|---|---|
| 6,954,994 | B1 * | 10/2005 | Teo et al. | 34/448 |
| 7,080,465 | B2 * | 7/2006 | Fujinami et al. | 34/619 |
| 7,334,348 | B2 * | 2/2008 | Morita | 34/628 |
| 7,334,588 | B2 * | 2/2008 | Verhaverbeke et al. | 134/148 |
| 7,424,781 | B2 * | 9/2008 | Fellingham et al. | 34/266 |
| 7,451,774 | B2 * | 11/2008 | Verhaverbeke et al. | 134/184 |
| 7,934,791 | B2 * | 5/2011 | Masuyama et al. | 347/34 |
| 7,966,743 | B2 * | 6/2011 | Piatt et al. | 34/82 |
| 8,322,047 | B2 * | 12/2012 | Soltysiak et al. | 34/620 |
| 8,347,525 | B2 * | 1/2013 | Gerde | 34/368 |
| 8,690,292 | B1 * | 4/2014 | Rimai et al. | 347/34 |
| 8,770,738 | B2 * | 7/2014 | Shifley et al. | 347/102 |
| 2003/0184630 | A1 | 10/2003 | Elgee | |
| 2006/0260642 | A1 * | 11/2006 | Verhaverbeke et al. | 134/1.3 |
| 2009/0200392 | A1 * | 8/2009 | Duru et al. | 239/13 |
| 2009/0200398 | A1 * | 8/2009 | Duru et al. | 239/102.2 |
| 2010/0199510 | A1 * | 8/2010 | Plavnik | 34/60 |
| 2011/0114744 | A1 * | 5/2011 | Ricciardi et al. | 239/4 |
| 2012/0192861 | A1 * | 8/2012 | Surber | 128/200.16 |
| 2012/0291989 | A1 * | 11/2012 | Fong et al. | 165/45 |
| 2014/0150284 | A1 * | 6/2014 | Ciaschi et al. | 34/279 |
| 2014/0150285 | A1 * | 6/2014 | Bucks et al. | 34/279 |
| 2014/0152749 | A1 * | 6/2014 | Shifley et al. | 347/102 |
| 2014/0152750 | A1 * | 6/2014 | Shifley et al. | 347/102 |
| 2014/0202024 | A1 * | 7/2014 | Bucks et al. | 34/279 |
| 2014/0234949 | A1 * | 8/2014 | Wasson et al. | 435/287.2 |

* cited by examiner

ACOUSTIC DRYING SYSTEM WITH INTERSPERSED EXHAUST CHANNELS

CROSS-REFERENCE TO RELATED APPLICATIONS

Reference is made to commonly assigned, U.S. patent application Ser. No. 13/693,309, now U.S. Pat. No. 8,770,738, entitled: "Acoustic drying system with matched exhaust flow", by Shifley et al.; and to commonly assigned, co-pending U.S. patent application Ser. No. 13/693,366, entitled: "Acoustic drying system with peripheral exhaust conduits", by Bucks et al., each of which is incorporated herein by reference.

FIELD OF THE INVENTION

The present invention relates to the drying of a medium which has received a coating of a liquid material, and more particularly to the use of an air impingement stream and acoustic energy to dry the volatile components of the coating.

BACKGROUND OF THE INVENTION

There are many examples of processes where liquid coatings are applied to the surface of a medium, and where it is necessary to remove a volatile portion of the liquid coating by some drying process. The image-wise application of aqueous inks in a high speed inkjet printer to generate printed product, and the subsequent removal of water from the image-wise ink deposit, is one example of such a process. Web coating of either aqueous or organic solvent based materials in the production of photographic films or thermal imaging donor material and the removal of water or solvent from the coated web is another example. The drying process often involves the application of heat and an airstream to evaporate the volatile portion of the liquid coating and remove the vapor from proximity to the medium. The application of heat and the removal of the volatile component vapor both accelerate the evaporation process.

In pneumatic acoustic generator air impingement drying systems, there are generally three components that are used to accelerate the drying process. Heated air is supplied through a slot in the dryer so that it impinges on the coated medium. This heated air supplies two of the components that accelerate drying: heat and an airstream. A third component that is used to accelerate the evaporation of volatile component of the liquid coating is the acoustic energy. The pneumatic acoustic generator is designed such that it generates acoustic waves (i.e., sound) at high sound pressure levels and at fixed frequencies as the impinging air stream passes through the main air channel of the pneumatic acoustic generator. The output of the pneumatic acoustic generator is an airstream that contains high levels of sound energy. The pressure fluctuations associated with the sound energy will disrupt the boundary layer that forms at the interface between the liquid coating and the air; this allows an accelerated transport of both heat and vapor at the liquid to gas boundary. In the absence of the pressure fluctuations associated with the sound energy, the transport of vapor across the boundary layer would rely on diffusion.

To be most efficient, the drying system needs to not only supply the air impingement stream for drying but also provide a means of removing that air from the air impingement drying region after it has collected volatile vapor from the coating. An air exhaust system is generally provided to remove air from the drying region. This exhaust air is typically heated to higher temperatures than components of the apparatus that are outside the drying system, and it carries significant quantities of water or solvent vapor generated during the drying process. If this hot, vapor-carrying air comes into contact with cooler components of the apparatus, the vapor may condense on those components. Condensation may collect to the point that it forms drops that may fall onto the medium that is being dried, thereby producing coating artifacts or image artifacts that are unacceptable. It would be advantageous to control the impingement and exhaust airstreams so that escape of the hot, vapor-laden-air from the drying system is not possible.

SUMMARY OF THE INVENTION

The present invention represents an acoustic air impingement drying system for drying a material, comprising:

an airflow source providing air at a supply flow rate;

a pneumatic transducer unit having a width dimension that spans a width of the material including:

an inlet chamber that receives air from the airflow source a plurality of acoustic resonant chambers, each having an inlet slot that receives air from the inlet chamber and an outlet slot that directs air onto the material, wherein the acoustic resonant chambers impart acoustic energy to the transiting air, the outlet slots being oriented at an oblique angle relative to the width dimension of the pneumatic transducer unit; and a plurality of exhaust air channels interspersed between the outlet slots for removing the air directed onto the material by the acoustic resonant chambers; and a blower for pulling air through the exhaust air channels at an exhaust flow rate.

This invention has the advantage that multiple acoustic air impingement slots can be provided in a small area and with better air flow and drying uniformity than would be possible with equivalent full-crosstrack-width air impingement slots packaged into the same area.

It has the additional advantage that shorter length acoustic air impingement dryer segments are required. It is easier to maintain the necessary critical dimensions in the shorter acoustic air impingement dryer segments than in full-crosstrack-width air impingement dryers.

It is to be understood that the attached drawings are for purposes of illustrating the concepts of the invention and may not be to scale.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

The present invention will be directed in particular to elements forming part of, or in cooperation more directly with the apparatus in accordance with the present invention. It is to be understood that elements not specifically shown or described may take various forms well known to those skilled in the art.

Figure 1:
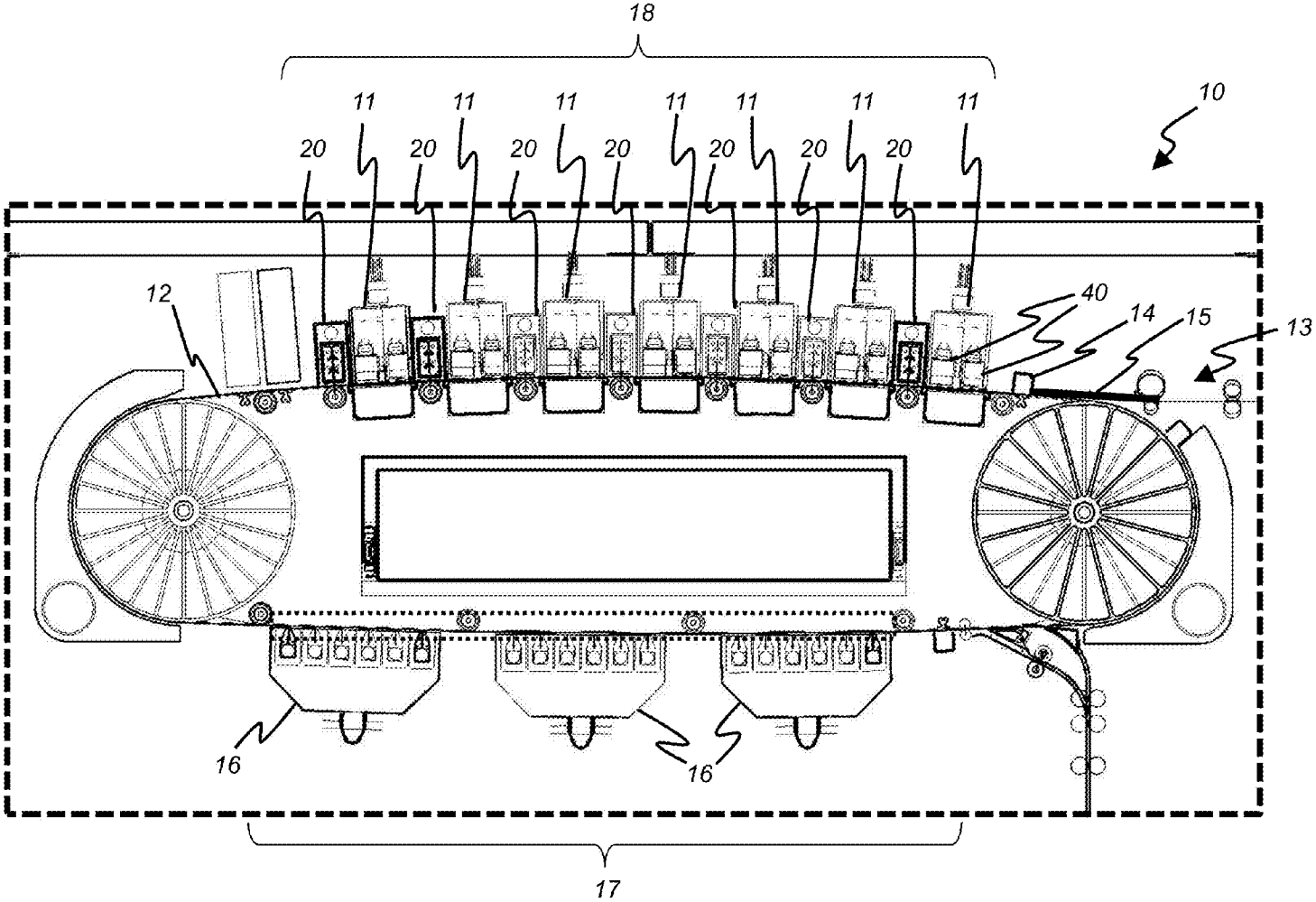
FIG. 1 is a cross-sectional, schematic view of a sheet-fed inkjet marking engine.

FIG. 1 shows a sheet-fed inkjet printer 10 including seven inkjet printhead modules 11 arranged in an ink printing zone 18, wherein each inkjet printhead module 11 contains two inkjet printheads 40, each having an array of ink nozzles for printing drops of ink onto an ink receiver medium 15. Acoustic air impingement dryers 20 are positioned downstream of each inkjet printhead module 11. Sheets of ink receiver media 15 are fed into contact with transport web 12 by sheet feed device 13, and the sheets of ink receiver media 15 are electrostatically tacked down to the transport web 12 by corona discharge from a tackdown charger 14. Transport web 12, which is rotating in a counterclockwise direction in this example, then transports the sheets of ink receiver media 15 through the ink printing zone 18 such that a multi-color image is formed on the ink receiver medium 15. The inkjet printheads 40 would typically print inks that contain dye or pigment of the subtractive primary colors cyan, magenta, yellow, and black and produce typical optical densities such that the image would have a transmission density in the primarily absorbed light color, as measured using a device such as an X-Rite Densitometer with Status A filters of between 0.6 and 1.0.

Acoustic air impingement dryers 20 are placed immediately downstream of each inkjet printhead module 11 so that image defects are not generated because of a buildup of liquid ink on the receiver sheet to the point that the ink starts to coalesce and bead up on the surface of the receiver. Poor print quality characteristics can occur if too much ink is delivered to an area of the receiver surface such that a large amount of liquid is on the surface. Controlling coalescence by immediate drying rather than relying on media coatings or the control of other media and/or ink properties allows for more latitude in the selection of the ink receiver medium. It is not necessary for the acoustic air impingement dryer to completely dry the ink deposit. It is only necessary for the dryer to remove enough of the liquid to avoid image quality artifacts.

As shown in FIG. 1, after leaving the ink printing zone 18 the ink receiver medium 15 continues to be transported on the transport web 12 to a final drying zone 17 where any of a number of drying technologies could be used to more fully dry the ink deposit. In the example print engine shown in FIG. 1, conventional air impingement dryers 16 are used to provide final drying. After final drying the sheet can be returned to the ink printing zone 18 by transport web 12 for additional printing on the first side in register with the already printed image, the sheet can be removed from the web and delivered as printed product, or the sheet can be sent through a turn-around mechanism (not shown), reintroduced to the transport web 12 at the sheet feed device 13, and printed on the second side.

In order to produce a high speed inkjet printer in a compact configuration, a compact dryer design must be provided so that the dryers can be placed in proximity to the inkjet printhead modules 11. Acoustic air impingement dryers 20 provide a compact design that can sufficiently dry the ink deposits between inkjet printhead modules 11 to prevent the image quality artifacts associated with ink coalescence.

Figure 2:
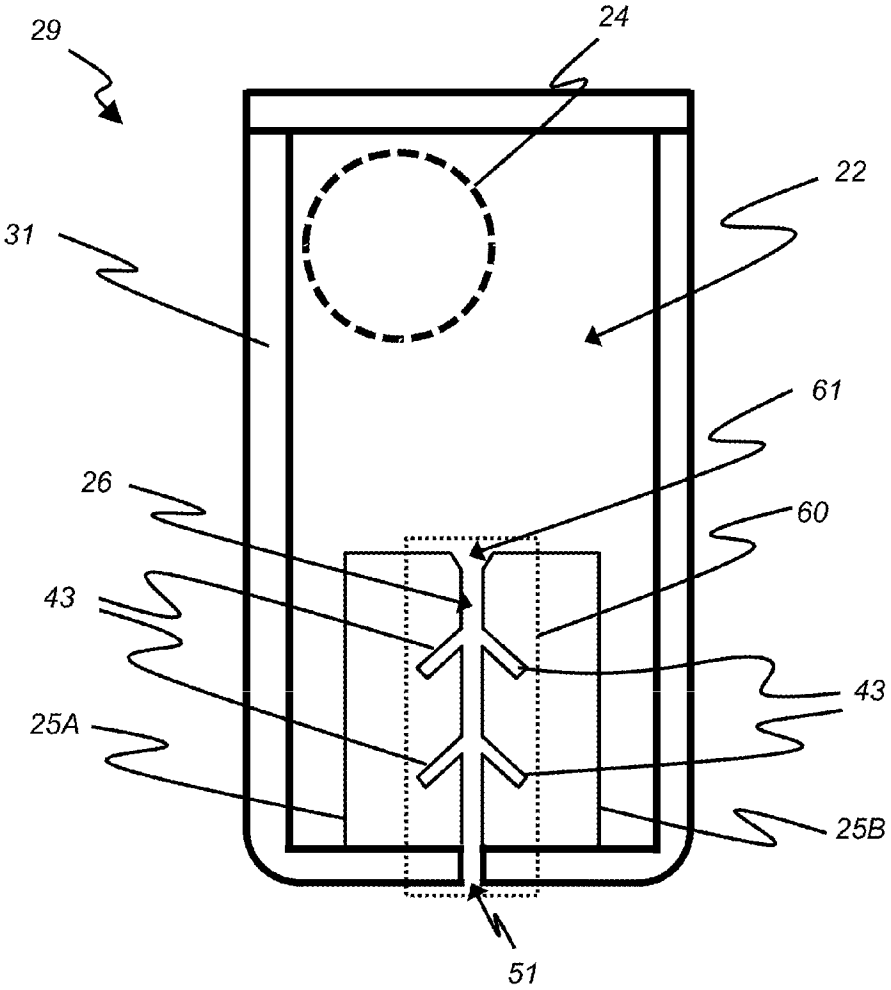
FIG. 2 is a transverse cross-sectional view of a pneumatic acoustic generator module according to one embodiment of the invention.

FIG. 2 is a transverse cross-sectional drawing of an exemplary embodiment of a pneumatic acoustic generator module 29 that can be incorporated into an acoustic air impingement dryer 20 (FIG. 1). Heated air is supplied to a supply air chamber 22 enclosed within a supply air chamber enclosure 31 via supply air duct 24 and enters acoustic resonant chamber 60 by passing through main air channel inlet slot 61. The acoustic resonant chamber 60 comprises the air channels outlined by the dotted rectangle in the figure, and includes the main air channel inlet slot 61, a main air channel 26, a main air channel exit slot 51, and closed-end resonant chambers 43. The main air channel 26 is the space formed between two pneumatic acoustic generator halves 25A and 25B. The closed-end resonant chambers 43 are cavities formed in the two pneumatic acoustic generator halves 25A and 25B.

As an air stream enters the acoustic resonant chamber 60 through the main air channel inlet slot 61 and flows through the main air channel 26 standing acoustic waves are generated in the closed-end resonant chambers 43. The standing acoustic waves in each closed-end resonant chamber 43 combine to generate high acoustic energy levels (i.e., sound levels) in the air flowing through the main air channel 26. The airflow that exits through the main air channel exit slot 51 and impinges on the ink and ink receiver medium 15 (FIG. 1) accelerates drying by providing heat, a means of removing evaporated solvent (water), and disruption of the boundary layer formed at the liquid-to-gas phase interface. This boundary layer disruption is provided by the high levels of acoustic pressure in the air stream.

Figure 3:
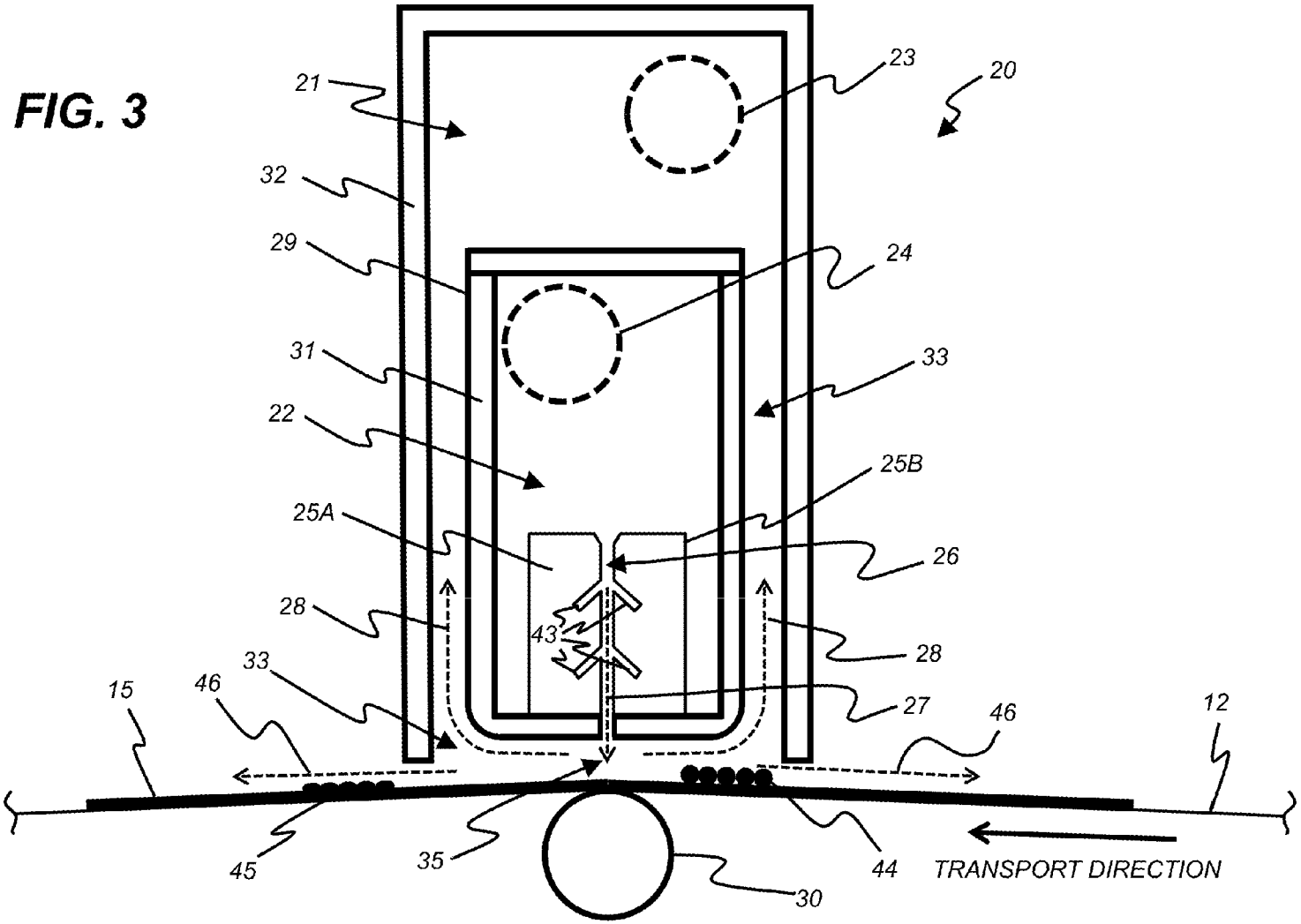
FIG. 3 is a transverse cross-sectional view of an acoustic air impingement dryer including a pneumatic acoustic generator module according to an embodiment of the invention.

A transverse cross sectional drawing of an exemplary embodiment of an acoustic air impingement dryer 20 including a pneumatic acoustic generator module 29 is shown in FIG. 3. Air, which may be heated, is supplied to the pneumatic acoustic generator module 29 via supply air duct 24 into supply air chamber 22 enclosed by supply air chamber enclosure 31, and exits the pneumatic acoustic generator module 29 through the main air channel 26 as impingement air stream 27. The main air channel 26 is formed between the pneumatic acoustic generator halves 25A and 25B. Closed-end resonant chambers 43 are formed into the pneumatic acoustic generator halves 25A and 25B and function to generate the acoustic energy that is imparted to the impingement air stream 27 as it passes through the main air channel 26.

The impingement air stream 27 exits the acoustic air impingement dryer 20 through the main air channel 26 and strikes the sheet of ink receiver medium 15 being transported by transport web 12 in an air impingement drying zone 35. The transport web 12 and the ink receiver medium 15 are supported by backup roller 30 in the air impingement drying zone 35. The ink receiver medium 15 has an image-wise ink deposit 44 on its surface supplied by the upstream inkjet printhead modules 11 and is being transported though the ink printing zone 18 (FIG. 1) by the transport web 12. The drying and reduction in water volume provided by impingement air stream 27 is illustrated by the partially-dried ink deposit 45, which is shown exiting the acoustic air impingement dryer 20 on the downstream side.

After striking the ink receiver medium 15 and ink deposit 44, the impingement air stream 27 contains water vapor as a result of the partial removal of water during the drying of ink deposit 44. At least some of the impingement air stream 27 follows the path indicated by exhaust air streams 28 through exhaust air channels 33 provided on both sides of the pneumatic acoustic generator module 29 and flows into exhaust air chamber 21 enclosed by exhaust air chamber enclosure 32. The air then exits the acoustic air impingement dryer 20 through exhaust air duct 23. Any of the moisture-laden impingement air stream 27 which does not follow the exhaust air stream 28 path into the exhaust air chamber 21 will escape from the acoustic air impingement dryer 20 as shown by escaping air 46.

Figure 4:
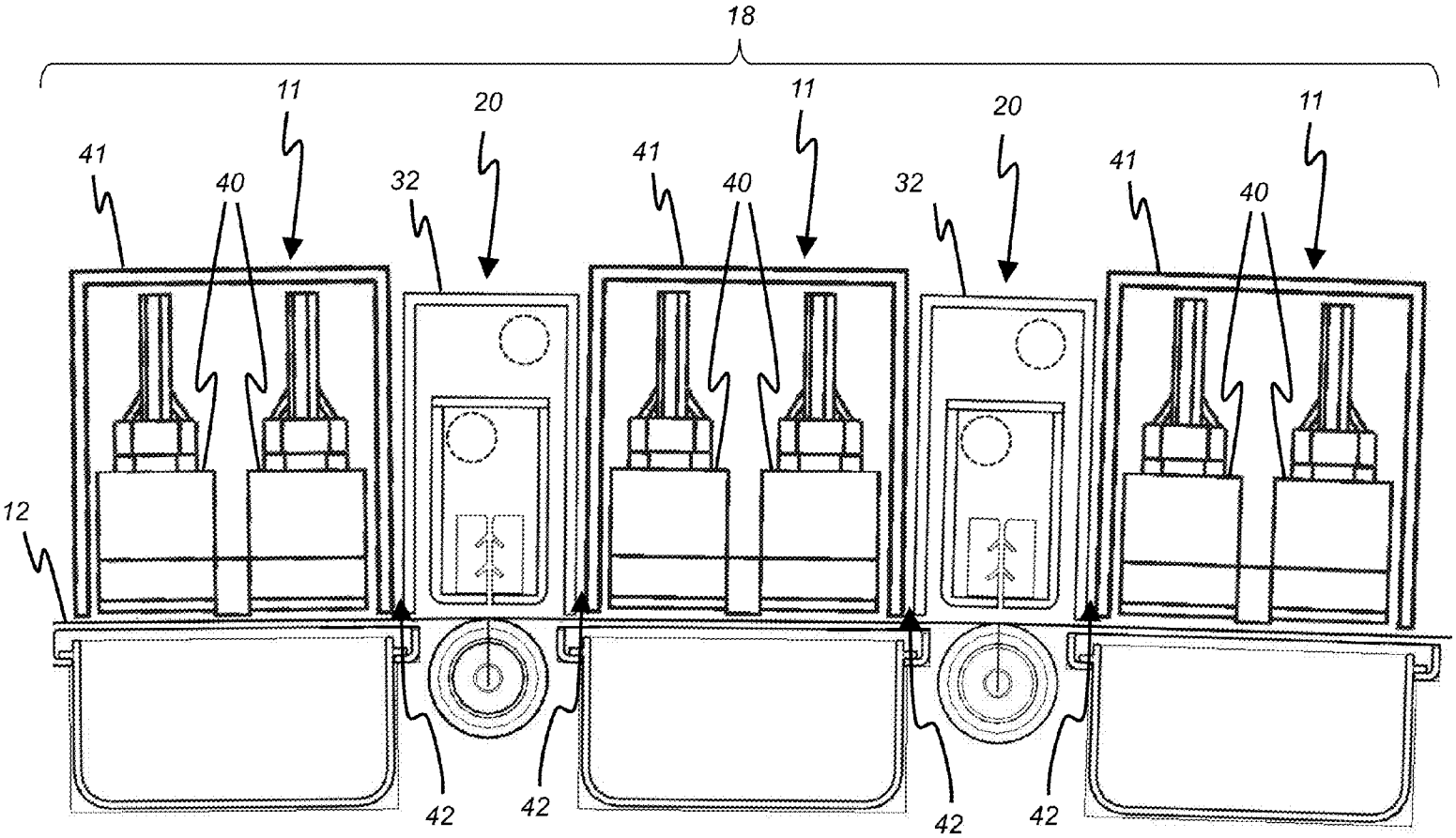
FIG. 4 is a cross-sectional schematic view of a portion of the ink printing zone in the inkjet printer of FIG. 1 showing the location of the inkjet printheads and the acoustic air impingement dryers according to an embodiment of the invention.

FIG. 4 shows a segment of the ink printing zone 18 of inkjet printer 10 (FIG. 1) that includes three inkjet printing modules 11, each having two inkjet printheads 40, and two acoustic air impingement dryers 20. These components are in close proximity to each other to limit the size of the inkjet printer 10. In many cases, the distance between the main air channel exit slot 51 (FIG. 2) of the acoustic air impingement dryers 20 and the ink nozzles in the nearest inkjet printhead 40 will be 45 mm or less, with the gap between the outer surfaces of the acoustic air impingement dryers 20 and the inkjet printheads 40 being a few millimeters or less. The small gaps between the components, as well as other nearby surfaces, represent possible condensation formation regions 42 where any moisture laden air that may escape from the acoustic air impingement dryers 20 can be cooled by contact with the surrounding components and cause condensation. The air supplied to acoustic air impingement dryers 20 is heated to accelerate the drying process, and this heated air will heat the walls of the exhaust air chamber enclosure 32. However, inkjet printhead enclosures 41 enclosing the inkjet printheads 40 will not be subjected to a significant flow of heated air, and furthermore it is common to control the temperature of the ink in inkjet printheads 40. Therefore any moisture laden impingement air that escapes from the acoustic air impingement dryers 20 will cool when it comes in contact with the relatively cool inkjet printhead enclosures 41 and lead to the collection of condensation in the possible condensation formation regions 42. Condensation dripping onto the ink deposit 44 (FIG. 3) or the ink receiver medium 15 (FIG. 3) will lead to unacceptable image quality defects.

Applicants have recognized that condensation can be substantially prevented by controlling the flow of air through the drying system such that the moisture laden air is captured within the acoustic air impingement dryers 20 and is removed from the ink printing zone 18. The invention prevents condensation and condensation-related image quality defects by containing all of the moisture laden air from the acoustic air impingement dryers 20 and removing it from proximity to any possible condensation formation regions 42 within or in proximity to the ink printing zone 18.

Figure 5:
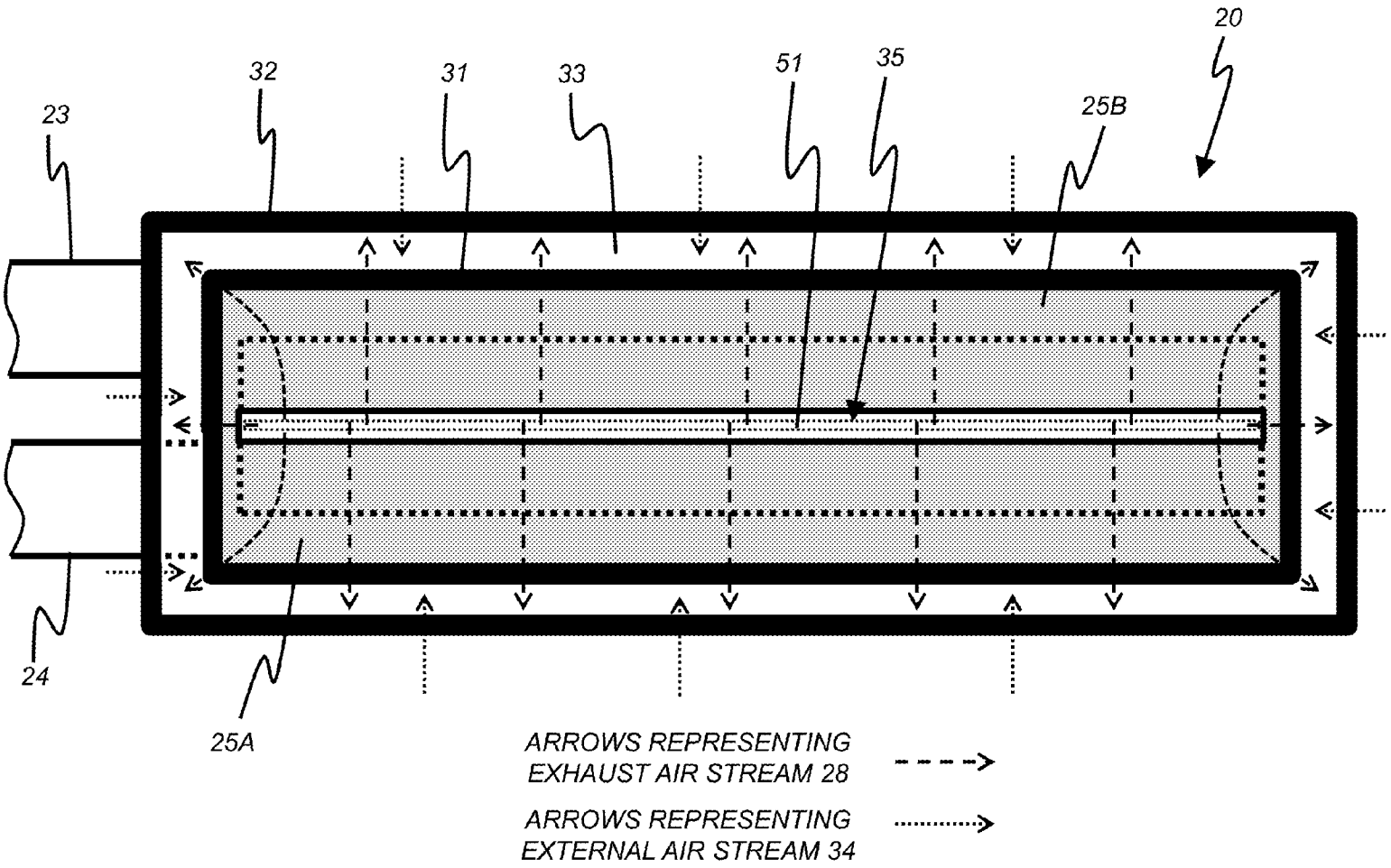
FIG. 5 is a bottom view of an acoustic air impingement dryer illustrating the associated airflow according to an embodiment of the invention.

FIG. 5 shows a bottom view of an acoustic air impingement dryer 20 where the supply and exhaust air flows can be adjusted and controlled such that the moisture laden impingement air does not escape from the drying system. After the impingement air stream exits the main air channel exit slot 51 between the pneumatic acoustic generator halves 25A and 25B, it contacts the ink receiver medium in air impingement drying zone 35 and becomes exhaust air stream 28 represented by the dashed arrows in FIG. 5. In the illustrated example, exhaust air channel 33 surrounds the main air channel exit slot 51 on all four sides and receives the exhaust air stream 28 and directs it into the exhaust air duct 23. The airflow in the exhaust air channel 33 between the supply air chamber enclosure 31 and the exhaust air chamber enclosure 32 is adjusted and controlled such that the airflow in exhaust air duct 23 is at least as large as the airflow in the supply air duct 24.

One advantage to the configuration of FIG. 5 is that the air path length that the exhaust air stream 28 must travel from the main air channel exit slot 51 to the exhaust air channel 33 can be made small in order to minimize the chances for condensation on components of the acoustic air impingement dryer 20 (e.g., on the outer surfaces of the pneumatic acoustic generator halves 25A and 25B).

Preferably, the airflow in the exhaust air duct 23 is sufficiently larger than the airflow in the supply air duct 24 that a small amount of air from outside the acoustic air impingement dryer 20 is drawn into the exhaust air channel 33 as represented by the dotted arrows of external air stream 34. If the acoustic air impingement dryer 20 is operated in this condition, most or all of the moisture laden air in the exhaust air stream 28 will be captured and drawn into the exhaust air channel, and will not escape into the possible condensation formation region 42 (FIG. 4) where it could produce condensation in proximity to the ink printing zone 18.

Figure 6:
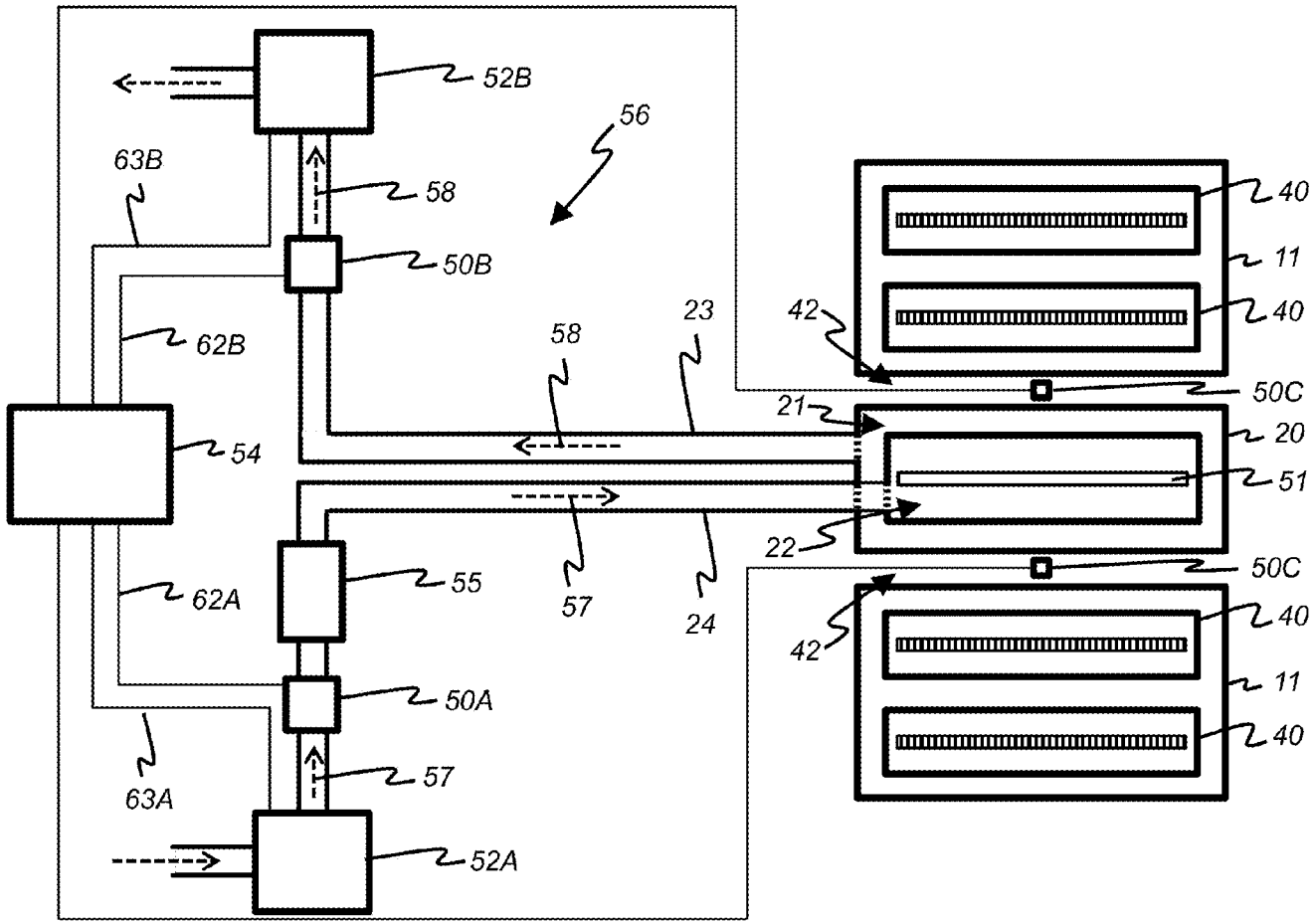
FIG. 6 is a schematic drawing of an airflow control system for controlling an acoustic air impingement dryer according to an alternate embodiment.

FIG. 6 shows a schematic drawing of an airflow control system 56 that can be used to prevent condensation-related artifacts in an inkjet printer 10 (FIG. 1) using acoustic air impingement dryers 20. The impingement air stream 27 (FIG. 3) that enters the air impingement drying zone 35 (FIG. 3) by exiting the acoustic air impingement dryer 20 through main air channel exit slot 51 is provided by a supply blower 52A. A supply flow rate of the supply air stream 57 is sensed by a supply airflow transducer 50A. The supply air stream 57 then passes through heater 55 and travels to the supply air chamber 22 through the supply air duct 24. Exhaust air is collected in exhaust air chamber 21 and exits the acoustic air impingement dryer 20 through the exhaust air duct 23 as exhaust air stream 58. Airflow through the exhaust air stream 58 is generated by exhaust blower 52B and an exhaust flow rate is sensed by an exhaust airflow transducer 50B.

Preferably, the supply flow rate and the exhaust flow rate provide an indication of the amount of air per unit of time passing through the corresponding duct in comparable units. In some cases, the supply flow rate and the exhaust flow rate are provided as mass flow rates (e.g., in units of grams of air per second). In some cases, the supply airflow transducer 50A and the exhaust airflow transducer 50B measure the airflow in some other units (e.g., air velocity), and the sensed quantities are converted to mass flow rates using appropriate transformations known to those skilled in the art.

Supply flow rate signal 62A and exhaust flow rate signal 62B that represent the sensed supply and exhaust airflow rates are provided to blower controller 54 by the supply airflow transducer 50A and the exhaust airflow transducer 50B, respectively. Supply blower control signal 63A and Exhaust blower control signal 63B are determined by the blower controller 54 in response to the supply flow rate signal 62A and the exhaust flow rate signal 62B are provided to the supply blower 52A and the exhaust blower 52B, respectively. The supply blower control signal 63A controls the supply blower 52A, and the exhaust blower control signal 63B controls the exhaust blower 52B, such that the impingement air stream 27 (FIG. 3) is maintained at a supply flow rate that is sufficient to provide adequate drying, and such that the exhaust flow rate in the exhaust air stream 58 is maintained at a value that is substantially equal to, or preferably somewhat greater than, the supply flow rate so that substantially all of the moisture-laden impingement air generated during the drying process is captured and removed from the ink printing zone 18 (FIG. 1). Within this context substantially equal flow rates should be interpreted to mean that the flow rates match to within 1%.

In a preferred embodiment, an aim supply flow rate ($V_{s,a}$) for the impingement air stream 27 is determined experimentally by adjusting the supply flow rate until adequate drying is observed for images being printed by the inkjet printer 10 (FIG. 1). The necessary flow rate will be a function of how much ink is being printed onto the ink receiver medium 15, so this experiment is preferably performed while the inkjet printer 10 is printing images having the highest expected ink lay down. In some cases, the aim supply flow rate may be constrained to fall within a particular range to excite the acoustic resonant chamber into resonance.

The blower controller 54 then controls the supply blower 52A by using a feedback control process to adjust the supply blower control signal 63A when a difference between the supply flow rate $V_s$ sensed by the supply airflow transducer 50A differs from the aim supply flow rate $V_{s,a}$ by more than a predefined threshold $T_s$ (i.e., $|V_s-V_{s,a}|>T_s$). Feedback control processes are well-known to those skilled in the process control art. In some embodiments, the predefined threshold $T_s$ is set to a percentage of the aim supply flow rate $V_{s,a}$ (e.g., $T_s=0.01\times V_{s,a}$).

Likewise, an aim exhaust flow rate $V_{e,a}$ is defined which is greater than or equal to the aim supply flow rate $V_{s,a}$. In some embodiments, the aim exhaust flow rate $V_{e,a}$ is set to be equal to the aim supply flow rate $V_{s,a}$. In this case, the blower controller 54 controls the exhaust blower 52B by sensing the supply flow rate and the exhaust flow rate, and using a feedback control process to adjust the exhaust blower control signal 63B when a difference between the exhaust flow rate $V_e$ sensed by the exhaust airflow transducer 50B differs from the supply flow rate $V_s$ sensed by the supply airflow transducer 50A by more than a predefined threshold $T_d$ (i.e., $|V_e-V_s|>T_d$). In some embodiments, the predefined threshold $T_e$ is set to a percentage of the aim supply flow rate $V_{s,a}$ (e.g., $T_d=0.01\times V_{s,a}$).

In some embodiments, the aim exhaust flow rate is specified to be somewhat larger than the aim supply flow rate:

$$V_{e,a}=V_{s,a}+\Delta V \tag{1}$$

where $\Delta V_a$ is an aim flow rate difference, which is a predefined non-negative constant. In some embodiments, the aim flow rate difference $\Delta V$ is set to a percentage of the aim supply flow rate $V_{s,a}$ (e.g., $\Delta V_a=0.02\times V_{s,a}$). The blower controller 54 then controls the exhaust blower 52B by using a feedback control process to adjust the exhaust blower control signal 63B when a difference between the exhaust flow rate $V_e$ sensed by the exhaust airflow transducer 50B differs from the aim exhaust flow rate $V_{e,a}$ by more than a predefined threshold $T_e$ (i.e., $|V_e-V_{e,a}|>T_e$).

In some embodiments, one or more inter-component airflow transducers 50C can optionally be provided in the possible condensation formation regions 42 between the acoustic air impingement dryers 20 and the inkjet printhead modules 11. The inter-component airflow transducers 50C are adapted to measure the magnitude and direction of an inter-component flow rate $V_i$ in the possible condensation formation regions 42. If the supply flow rate $V_s$ and the exhaust flow rate $V_e$ are properly balanced, then any airflow in possible condensation formation regions 42 should be small and should be in a direction toward the air impingement drying zone 35 (FIG. 3) (i.e., $V_i\leq 0$). If the inter-component flow rate $V_i$ sensed by the inter-component airflow transducers 50C is in a direction away from the air impingement drying zone 35 (i.e., $V_i>0$), this is an indication that some of the impinging air may be escaping and not being drawn into the exhaust air channel. In this case, the blower controller 54 controls the exhaust blower 52B by sensing the inter-component flow rate $V_i$, and using a feedback control process to adjust the exhaust blower control signal 63B when the sensed inter-component flow rate indicates that air is escaping from the air impingement drying zone 35 (i.e., $V_i>0$).

Figure 7:
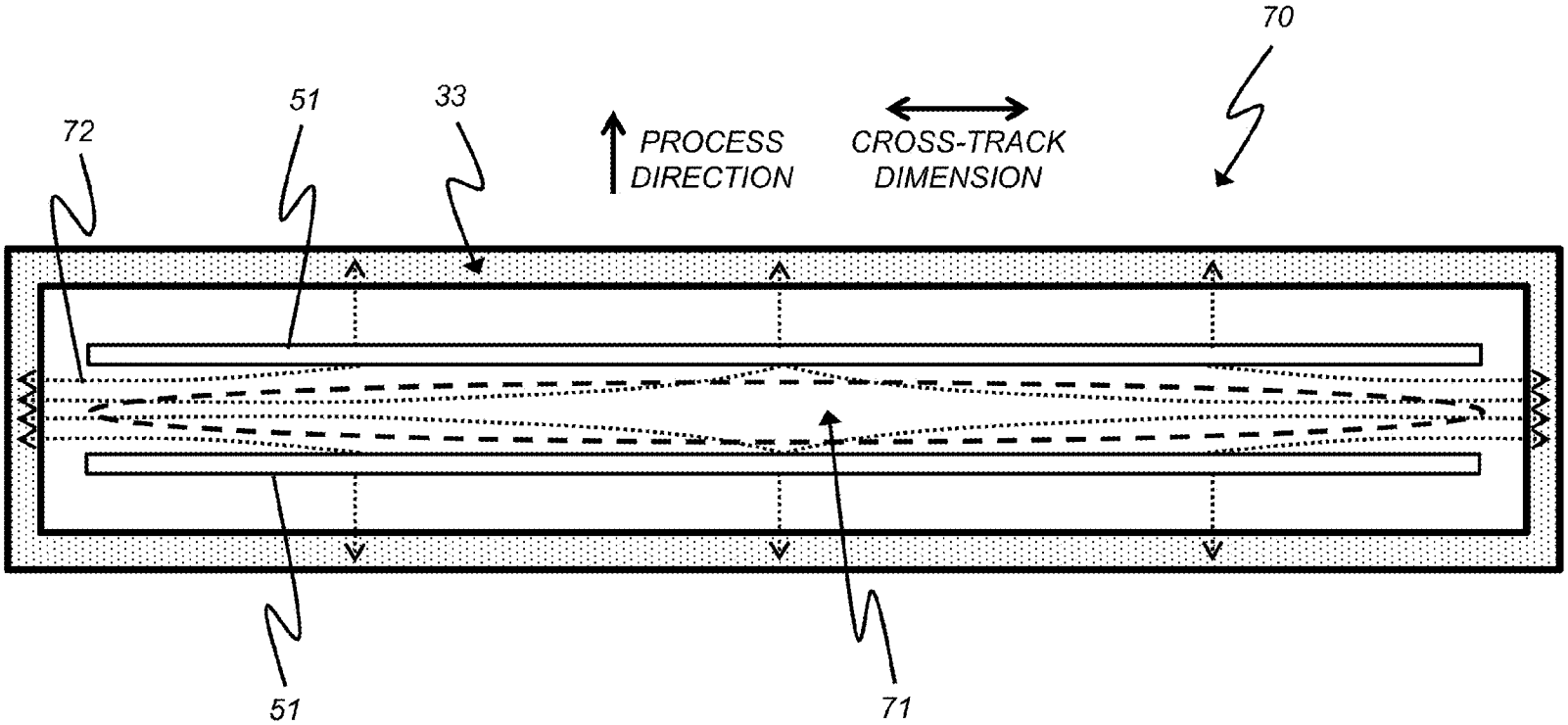
FIG. 7 is a bottom view of a double-linear-slot acoustic air impingement dryer according to an embodiment of the present invention.

Linear cross-track slots are typically used for acoustic air impingement drying. This creates a very small active drying zone if there is only one air impingement slot. A larger active drying zone can be provided using a multiple slot configuration as shown in FIG. 7, which is a bottom view of a double-linear-slot acoustic air impingement dryer 70. The impingement air exits the two main air channel exit slots 51 that span the entire printing width of the inkjet printer 10 (FIG. 1) and are perpendicular to the process direction (i.e., the direction that the ink receiver medium 15 (FIG. 1) moves past the acoustic air impingement dryer 70), and then flows to exhaust air channel 33 which surrounds the two main air channel exit slots 51. In this case, for the reasons discussed above, the total supply flow rate provided to the two main air channel exit slots 51 should be balanced with the total exhaust flow rate flowing through the exhaust air channel 33 in order to recapture the moist impinging air and prevent condensation on various printer components.

The FIG. 7 configuration is not optimal for spent air control and drying uniformity due to the fact that the impingement air does not have a short and direct path to the exhaust air channel 33 in the exhaust air interference zone 71, which is the central area enclosed by the dashed boundary in FIG. 7. In the exhaust air interference zone 71, the impingement air from both main air channel exit slots 51 is trying to flow through the same region and must exit the exhaust air interference zone 71 at one of the ends of this region, which are in proximity to exhaust air channel 33. The differences in air path length for several locations along one of the two main air channel exit slots 51 are illustrated by the air flow paths 72 (shown as dotted arrows). The differences in air path length will cause different air flow rates, and consequently different drying rates along the length of the acoustic air impingement dryer 70.

Another problem with using main air channel exit slots 51 that span the entire printing width if the inkjet printer 10 (FIG. 1) is holding consistent slot dimensions along the entire length of the slots. If the slot dimensions vary by ±250 microns, the output acoustic frequency can change by 10 to 20 kHz. When that happens, the ink receiving medium drying location (i.e., the distance from the main air channel exit slot to the ink receiving medium that leads to maximum drying) changes accordingly; this leads to a non-uniform drying rate along the length of the acoustic air impingement dryer.

Figure 8:
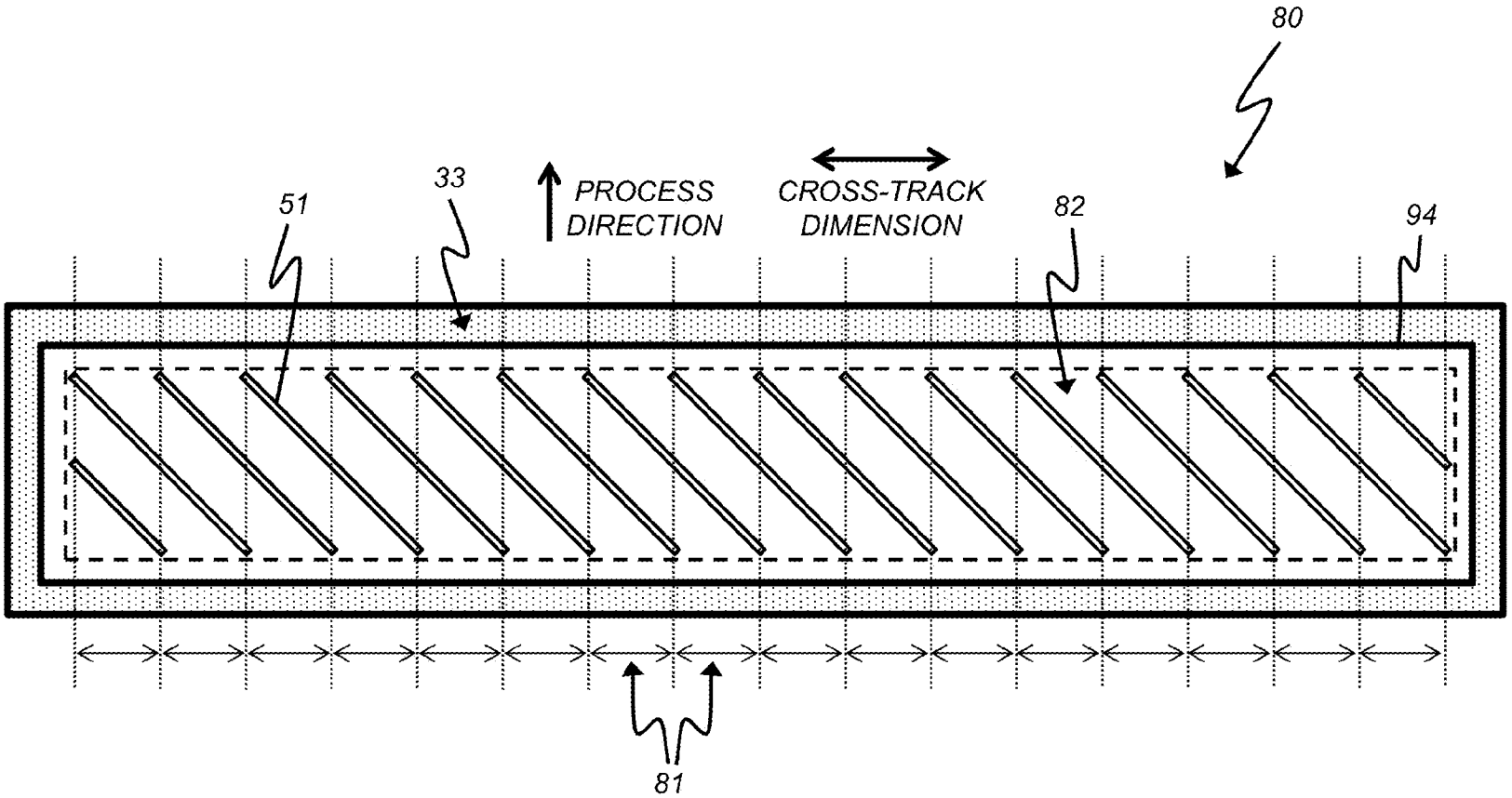
FIG. 8 is a bottom view of an acoustic air impingement dryer having an array of seventeen angled exit slots according to an alternate embodiment.

In some embodiments, these disadvantages are mitigated by using multiple short slots (e.g., of approximately 50 mm) configured in an array. FIG. 8 shows a bottom view of one such acoustic air impingement dryer 80 having an array of seventeen angled main air channel exit slots 51 formed into a baseplate 94. Each of the main air channel exit slots 51 is oriented at an oblique angle relative to the cross-track (width) dimension of the acoustic air impingement dryer 80, and also relative to the process direction. Each of the main air channel exit slots 51 will be associated with a corresponding acoustic resonant chamber (not shown in FIG. 8) having an inlet slot which receives air from the inlet chamber. One or more peripheral exhaust air channels 33 can be arranged around the outer boundary of the baseplate 94 for removing the air directed onto the ink receiver medium 15 (FIG. 1) by the main air channel exit slots 51. In the illustrated embodiment, the baseplate 94 is surrounded on all four sides by a single continuous exhaust air channel 33. In other embodiments, individual exhaust air channels 33 may be provided on some or all of the sides of the baseplate 94.

The configuration of FIG. 8 has the advantage that there is a much smaller variation in the air path length from the main air channel exit slots 51 to the exhaust air channel 33 relative to the double-linear-slot acoustic air impingement dryer 70 shown in FIG. 7. The smaller variation in air flow path length leads to more uniform impingement air flow, and more uniform drying. Furthermore, the ability to maintain slot dimensions in the shorter main air channel exit slots 51 of the acoustic air impingement dryer 80 is an additional benefit of this configuration.

Another advantage to the configuration of FIG. 8 is that the length of the longest air path length that the air must travel from the main air channel exit slots 51 to the exhaust air channel 33 is significantly smaller than for the configuration of FIG. 7. This reduces the chances for condensation on the baseplate 94.

The region of the baseplate 94 including the main air channel exit slots 51 defines a drying zone 82 (shown with a dashed boundary) within which air impinges onto the ink receiver medium 15. The dotted lines in FIG. 8 indicate the boundaries of each of sixteen double pass drying zone portions 81 that are formed under the acoustic air impingement dryer 80. As the ink receiver medium 15 (FIG. 1) passes under the acoustic air impingement dryer 80 every point on the ink receiver medium 15 passes through the impingement air stream that is emitted by two of the main air channel exit slots 51. Therefore, each point on the ink receiver medium 15 is exposed to two impingement air streams for both the angled-slot acoustic air impingement dryer 80 shown in FIG. 8 and the double-linear-slot acoustic air impingement dryer 70 shown in FIG. 7, but the acoustic air impingement dryer 80 has the advantage of more uniform drying characteristics. It will be obvious to one skilled in the art that the number of impingement air streams to which a point on the ink receiver medium 15 is exposed can be adjusted by controlling the oblique angle of the main air channel exit slots 51.

Figure 9A:
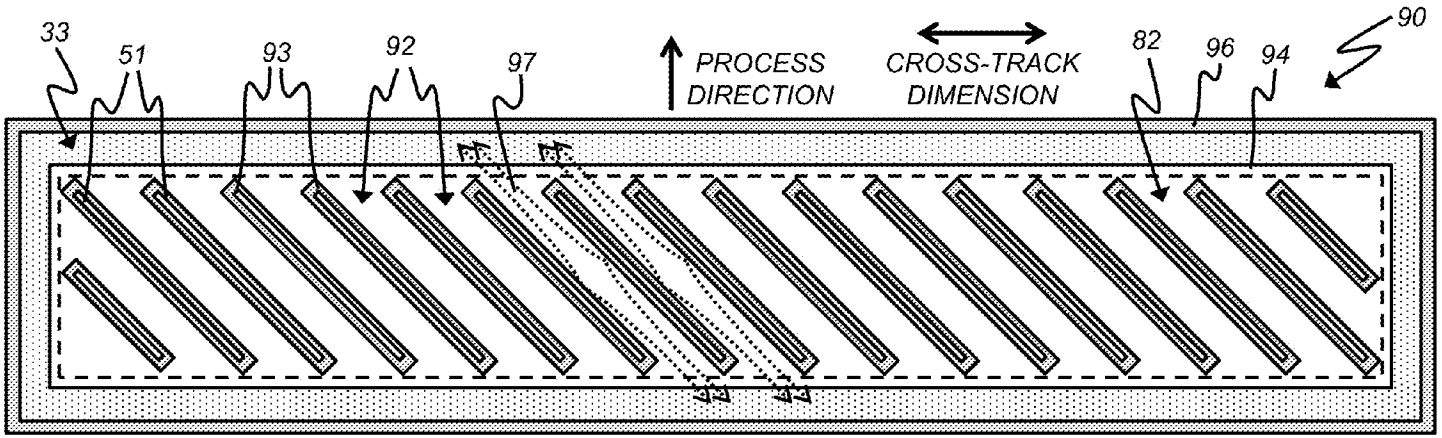
FIG. 9A is a bottom view of an acoustic air impingement dryer having an array of seventeen angled protruding exit slots according to an alternate embodiment.

FIG. 9A shows a bottom view of an acoustic air impingement dryer 90 that has main air channel exit slots 51 formed in protruding exit slot nozzles 93 that protrude from the baseplate 94. The region of the baseplate 94 including the main air channel exit slots 51 defines a drying zone 82 (shown with a dashed boundary) within which air impinges onto the ink receiver medium 15. In the illustrated embodiment, the main air channel exit slots 51 are arranged at an oblique angle relative to the cross-track (width) dimension of the acoustic air impingement dryer 90, and also relative to the process direction as in the acoustic air impingement dryer 80 FIG. 8.

The walls of protruding exit slot nozzles 93 form return flow channels 92 between the main air channel exit slots 51. Having the protruding exit slot nozzles 93 protrude down from the baseplate 94 with a gap between them provides well-defined air flow paths 97 (shown with dotted arrows) for the impingement air to travel from the main air channel exit slots 51 to the exhaust air channel 33 that encompasses the exterior boundary of the nozzle array, thereby improving air flow and drying uniformity.

In some embodiments, an air barrier 96 is formed around the exhaust air channel 33 to block air from passing out of the drying zone 82 into other areas of the inkjet printer 10 (FIG. 1). The air barrier 96 can be, for example, a protruding lip similar to the protruding exit slot nozzles 93 which provides a smaller gap between the air barrier 96 and the ink receiver medium 15 relative to the gap between the baseplate 94 and the ink receiver medium 15. In the illustrated embodiment, the air barrier 96 fully surrounds the exhaust air channel 33, which in turn fully surrounds the drying zone 82. In other embodiments, air barriers 96 may only be provided around a portion of the drying zone 82.

Figure 9B:
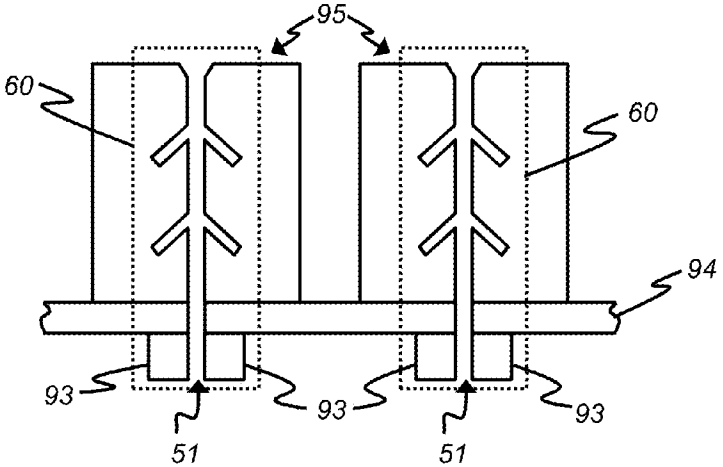
FIG. 9B is a cross-sectional transverse view of two pneumatic acoustic generators for the acoustic air impingement dryer of FIG. 9A.

FIG. 9B shows a cross-sectional transverse view of two pneumatic acoustic generators 95 from the acoustic air impingement dryer 90 in FIG. 9A. (The cross-section is at a 45 degree angle to the cross-track (width) dimension and the process direction.) The acoustic resonant chambers 60 now include the additional air flow path provided by protruding exit slot nozzles 93 which extend below the baseplate 94. In the acoustic air impingement dryer 90 (FIG. 9A), each point on the ink receiving sheet is exposed to the impingement air stream of two protruding exit slots.

Figure 10A:
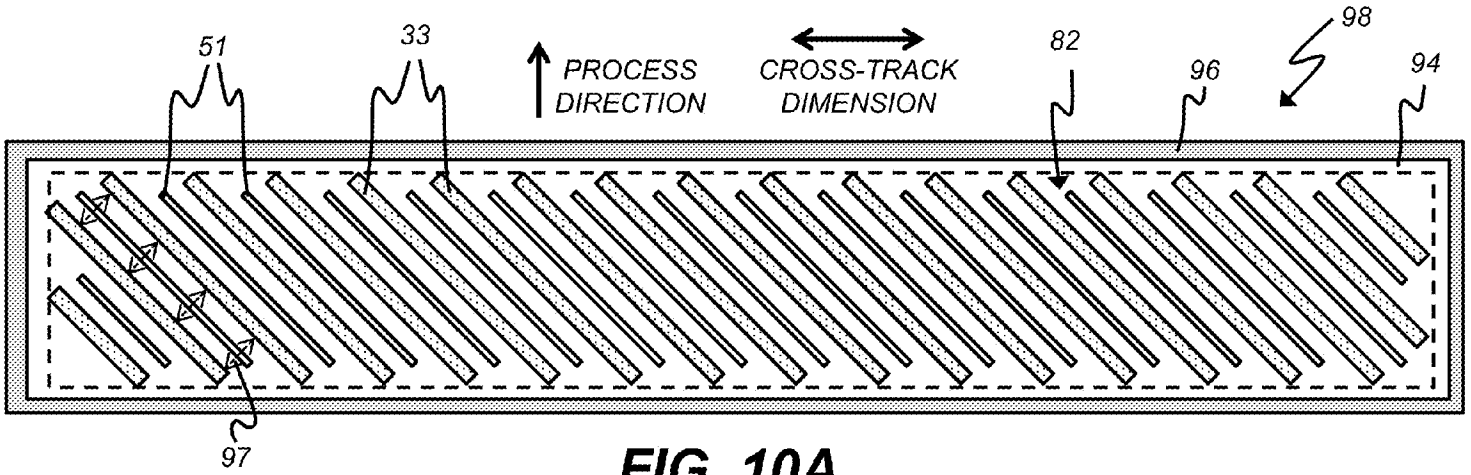
FIG. 10A is a bottom view of an acoustic air impingement dryer having an array of seventeen angled exit slots with interspersed exhaust air channels according to an alternate embodiment.

FIG. 10A is a bottom view of an acoustic air impingement dryer 98 having an array of seventeen angled main air channel exit slots 51 arranged in drying zone 82 with interspersed exhaust air channels 33 according to an alternate embodiment. In this embodiment, the exhaust air channels 33 are formed as slots in the baseplate 94 that are positioned between each of the main air channel exit slots 51. In this way, the air flow paths 97 have a consistent and short path length from the main air channel exit slots 51 to the exhaust air channels 33. In some embodiments, an air barrier 96 is provided surrounding the drying zone 82 to further limit the escaping of air from the acoustic air impingement dryer 98 into other portions of the inkjet printer 10. In some embodiments, exhaust air channels 33 can also be provided surrounding one or more sides of the drying zone 82 as in FIG. 9A to provide additional protection against escaping air.

Another advantage to the configuration of FIG. 10A is that the length of the longest air path length that the air must travel from the main air channel exit slots 51 to the exhaust air channel 33 is even smaller than that in the FIG. 8 and FIG. 9A configurations. This further reduces the chances for condensation on the baseplate 94.

Figure 10B:
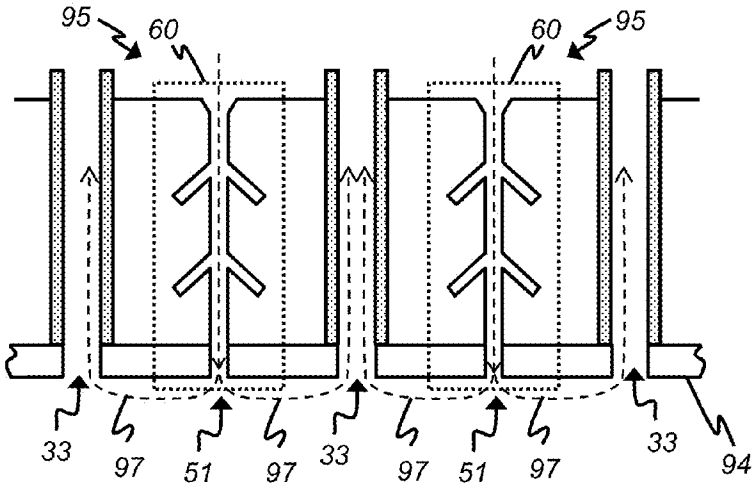
FIG. 10B is a cross-sectional transverse view of two pneumatic acoustic generators for the acoustic air impingement dryer of FIG. 10A.

FIG. 10B shows a cross-sectional transverse view of two pneumatic acoustic generators 95 from the acoustic air impingement dryer 98 in FIG. 10A. (The cross-section is at a 45 degree angle to the cross-track (width) dimension and the process direction.) The impinging air from the main air channel exit slots 51 follows the indicated air flow paths 97 to exit through one of the nearby exhaust air channels 33.

A further advantage of the angled slot configurations of FIGS. 8, 9A and 10A is that the airflow to individual main air channel exit slots 51 can be turned on or off in accordance with the width of the ink receiver medium 15 that is being dried. For wide media air can be supplied to all of the main air channel exit slots 51, and for narrower media air can be supplied to only a subset of the main air channel exit slots 51 that are positioned over the ink receiver medium 15.

It will be obvious to one skilled in the art that the airflow control system described relative to FIG. 6 can be applied to any of the alternate configurations shown in FIGS. 7, 8, 9A-B, and 10A-B. Generally, all of the main air channel exit slots 51 will be fed from a single airflow source being controlled to provide a supply air stream 57 (FIG. 6) at an appropriate supply flow rate. Likewise, all of the exhaust air channels 33 will feed into a single exhaust air stream 58 (FIG. 6) being controlled to provide an appropriate exhaust flow rate. As described earlier, proper control of the supply flow rate and the exhaust flow rate can be used to prevent impinging air from escaping into other areas of the inkjet printer 10 (FIG. 1).

The invention has been described in detail with particular reference to certain preferred embodiments thereof, but it will be understood that variations and modifications can be effected within the spirit and scope of the invention.

PARTS LIST

10 inkjet printer
11 inkjet printhead module
12 transport web
13 sheet feed device
14 tackdown charger
15 ink receiver medium
16 air impingement dryer
17 final drying zone
18 ink printing zone
20 acoustic air impingement dryer
21 exhaust air chamber
22 supply air chamber
23 exhaust air duct
24 supply air duct
25A pneumatic acoustic generator half
25B pneumatic acoustic generator half
26 main air channel
27 impingement air stream
28 exhaust air stream
29 pneumatic acoustic generator module
30 backup roller
31 supply air chamber enclosure
32 exhaust air chamber enclosure
33 exhaust air channel
34 external air stream
35 air impingement drying zone
40 inkjet printhead
41 inkjet printhead enclosure
42 possible condensation formation region
43 closed-end resonant chambers
44 ink deposit
45 partially dried ink deposit
46 escaping air
50A supply airflow transducer
50B exhaust airflow transducer
50C inter-component airflow transducer
51 main air channel exit slot
52A supply blower
52B exhaust blower
54 blower controller
55 heater
56 airflow control system
57 supply air stream
58 exhaust air stream
60 acoustic resonant chamber
61 main air channel inlet slot
62A supply flow rate signal
62B exhaust flow rate signal
63A supply blower control signal
63B exhaust blower control signal
70 acoustic air impingement dryer
71 exhaust air interference zone
72 air flow paths
80 acoustic air impingement dryer
81 double pass drying zone portions
82 drying zone
90 acoustic air impingement dryer
92 return flow channel
93 protruding exit slot nozzles
94 baseplate
95 pneumatic acoustic generator
96 air barrier
97 air flow paths
98 acoustic air impingement dryer

The invention claimed is:

1. An acoustic air impingement drying system for drying a material, comprising:

an airflow source providing air at a supply flow rate;

a pneumatic transducer unit having a width dimension that spans a width of the material including:

an inlet chamber that receives air from the airflow source a plurality of acoustic resonant chambers, each having an inlet slot that receives air from the inlet chamber and an outlet slot that directs air onto the material, wherein the acoustic resonant chambers impart acoustic energy to the transiting air, the outlet slots being oriented at an oblique angle relative to the width dimension of the pneumatic transducer unit; and a plurality of exhaust air channels interspersed between at least some of the outlet slots for removing the air directed onto the material by the acoustic resonant chambers; and a blower for pulling air through the exhaust air channels at an exhaust flow rate.

2. The acoustic air impingement drying system of claim 1, wherein exhaust air channels are interspersed between all of the outlet slots.

3. The acoustic air impingement drying system of claim 1 further including one or more air barriers arranged around the outer boundary of the peripheral exhaust air channels that block air from passing out of the drying zone.

4. The acoustic air impingement drying system of claim 1, further including a blower controller that controls the exhaust flow rate, wherein the exhaust flow rate is controlled to match the supply flow rate to within 1%, or o exceed the supply flow rate.

5. The acoustic air impingement drying system of claim 4 wherein the exhaust flow rate is controlled by sensing the supply flow rate and the exhaust flow rate, and adjusting the exhaust flow rate when a difference between the sensed supply flow rate and the sensed exhaust flow rate exceeds a predefined threshold.

6. The acoustic air impingement drying system of claim 5 wherein the acoustic air impingement drying system is a component of an inkjet printing system including one or more inkjet printheads, and wherein the exhaust flow rate is controlled by sensing an airflow rate at a position intermediate to the acoustic air impingement drying system and one of the inkjet printheads.

7. The acoustic air impingement drying system of claim 1 further including a blower controller that controls the supply flow rate and the exhaust flow rate, wherein the supply flow rate is controlled by sensing the supply flow rate and adjusting the supply flow rate when a difference between the sensed supply flow rate and a predefined aim supply flow rate exceeds a predefined threshold, and the exhaust flow rate is controlled by sensing the exhaust flow rate, and adjusting the exhaust flow rate when a difference between the sensed exhaust flow rate and a predefined aim exhaust flow rate exceeds a predefined threshold, the aim exhaust flow rate being greater than or equal to the aim supply flow rate.

8. The acoustic air impingement drying system of claim 1 further including one or more peripheral exhaust air channels arranged around the outer boundary of the drying zone for removing the air directed onto the material by the acoustic resonant chambers.

9. The acoustic air impingement drying system of claim 1 wherein the material is moved past the pneumatic transducer unit in a direction that is substantially perpendicular to the width dimension of the pneumatic transducer unit.

10. The acoustic air impingement drying system of claim 9 wherein the each point on the material is moved past the outlet slots for at least two acoustic resonant chambers.

11. The acoustic air impingement drying system of claim 1 wherein the material is an inkjet receiver medium that has been moistened by applying ink using one or more inkjet printheads.

12. The acoustic air impingement drying system of claim 1 wherein individual acoustic resonant chambers are controlled so that air is only provided by a subset of the acoustic resonant chambers in accordance with a width of the material.

* * * * *